US011654535B2

(12) United States Patent
Chiang

(10) Patent No.: US 11,654,535 B2
(45) Date of Patent: May 23, 2023

(54) TORQUE TOOL

(71) Applicant: William Tools Co., Ltd., Taichung (TW)

(72) Inventor: Shui-Lai Chiang, Taichung (TW)

(73) Assignee: WILLIAM TOOLS CO., LTD., Taichung (TW)

( * ) Notice: Subject to any disclaimer, the term of this patent is extended or adjusted under 35 U.S.C. 154(b) by 0 days.

(21) Appl. No.: 17/556,301

(22) Filed: Dec. 20, 2021

(65) Prior Publication Data

US 2022/0250218 A1 Aug. 11, 2022

(30) Foreign Application Priority Data

Feb. 5, 2021 (TW) ..... 110104407

(51) Int. Cl.
*B25B 23/142* (2006.01)
*B25B 23/14* (2006.01)

(52) U.S. Cl.
CPC ..... *B25B 23/1427* (2013.01); *B25B 23/141* (2013.01)

(58) Field of Classification Search
CPC . B25B 23/141; B25B 23/1427; B25B 23/142; B25B 23/1422; B25B 23/16
USPC ..... 81/467–478
See application file for complete search history.

(56) References Cited

U.S. PATENT DOCUMENTS

2021/0001459 A1* 1/2021 Tsai ..... B25B 23/0042

FOREIGN PATENT DOCUMENTS

TW M524242 U * 6/2016 ..... B25B 23/1427

* cited by examiner

*Primary Examiner* — Don M Anderson
*Assistant Examiner* — Robert C Moore
(74) *Attorney, Agent, or Firm* — Muncy, Geissler, Olds & Lowe, P.C.

(57) ABSTRACT

A torque tool is provided, including: a main body, defining an axial direction, an end of the main body on the axial direction including a working portion, the working portion being freely rotatable when receiving a torque larger than a predetermined torque; a torque assembly, including an abutting assembly, the abutting assembly being non-rotatably and slidably disposed in the main body in the axial direction for adjusting the predetermined torque; a shaft, including a first threaded portion and a second threaded portion, the first threaded portion and the second threaded portion extending spirally in opposing directions, the first threaded portion being screwed to the main body, the second threaded portion being screwed to the abutting assembly; an adjusting assembly, disposed on the main body and rotatable about the axial direction, connected with and non-rotatable relative to the shaft.

10 Claims, 7 Drawing Sheets

TORQUE TOOL

BACKGROUND OF THE INVENTION

Field of the Invention

The present invention relates to a torque tool.

Description of the Prior Art

A torque tool capable of adjusting torque setting value is usually used in fastening or unfastening fasteners, which can avoid problems such as damage to the object or the fastener due to over-tightening. A working portion is provided at one end of a main body of the torque tool, a torque adjusting shaft is provided in the main body to adjust the torque setting value, a rotatable adjusting member is installed at the other end of the main body, and the rotatable adjusting member is screwed with the torque adjusting shaft. When turning the rotatable adjusting member, the torque adjustment shaft is driven by the rotatable adjusting member to move axially, thereby adjusting the torque setting value. However, it needs to turn the rotatable adjusting member for many turns for setting a torque between a lowest limit torque and a highest limit torque, and thus it is inconvenient in use.

The present invention is, therefore, arisen to obviate or at least mitigate the above-mentioned disadvantages.

SUMMARY OF THE INVENTION

The main object of the present invention is to provide a torque tool with which a predetermined torque can be considerably adjusted by less rotation of an adjusting mechanism.

To achieve the above and other objects, a torque tool is provided, including: a main body, defining an axial direction, an end of the main body on the axial direction including a working portion, the working portion being freely rotatable when receiving a torque larger than a predetermined torque; a torque assembly, including an abutting assembly, the abutting assembly being non-rotatably and slidably disposed in the main body in the axial direction for adjusting the predetermined torque; a shaft, including a first threaded portion and a second threaded portion, the first threaded portion and the second threaded portion extending spirally in opposing directions, the first threaded portion being screwed to the main body, the second threaded portion being screwed to the abutting assembly; an adjusting assembly, disposed on the main body and rotatable about the axial direction, connected with and non-rotatable relative to the shaft.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
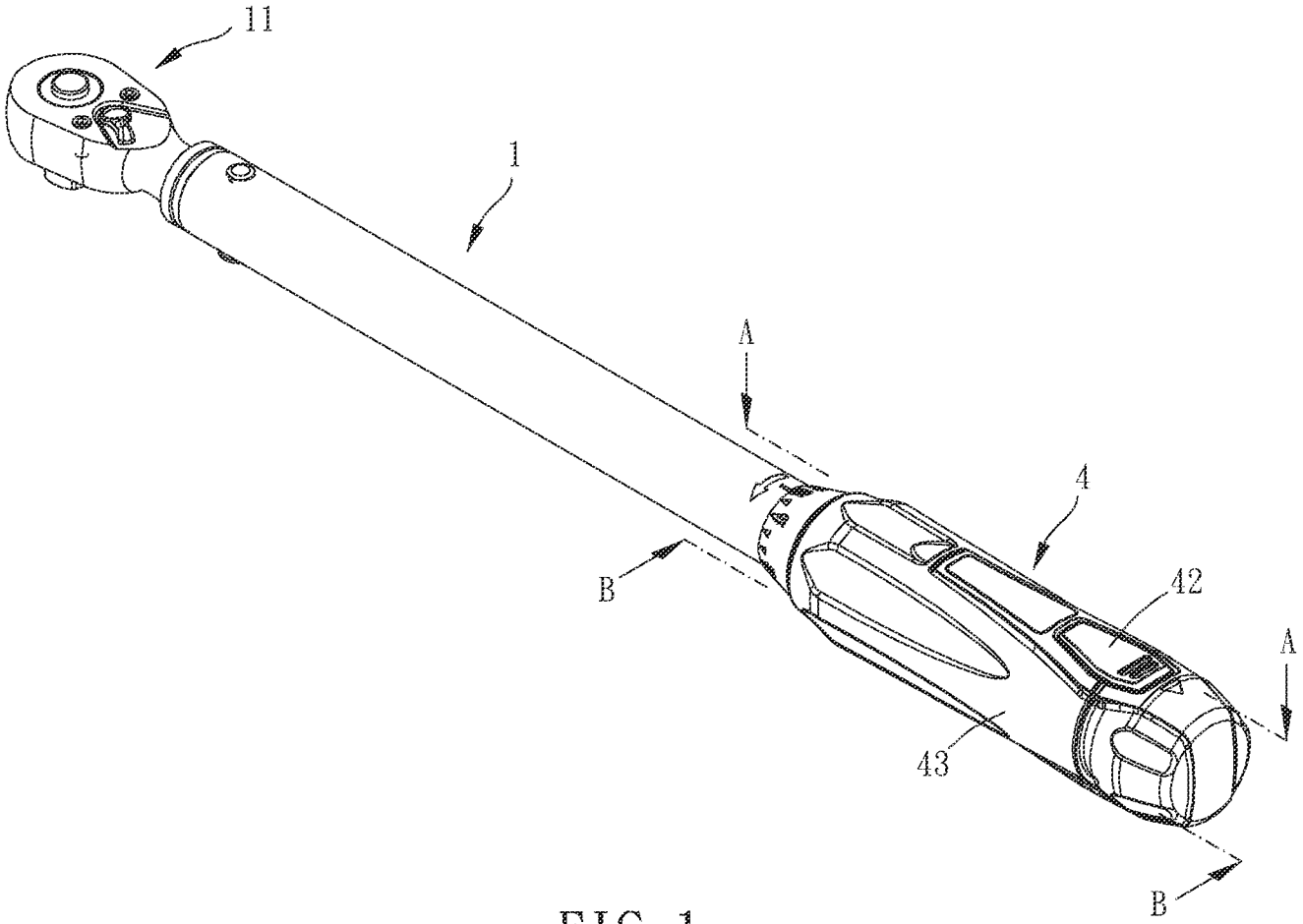
FIG. 1 is a stereogram of a preferable embodiment of the present invention.
Figure 2:
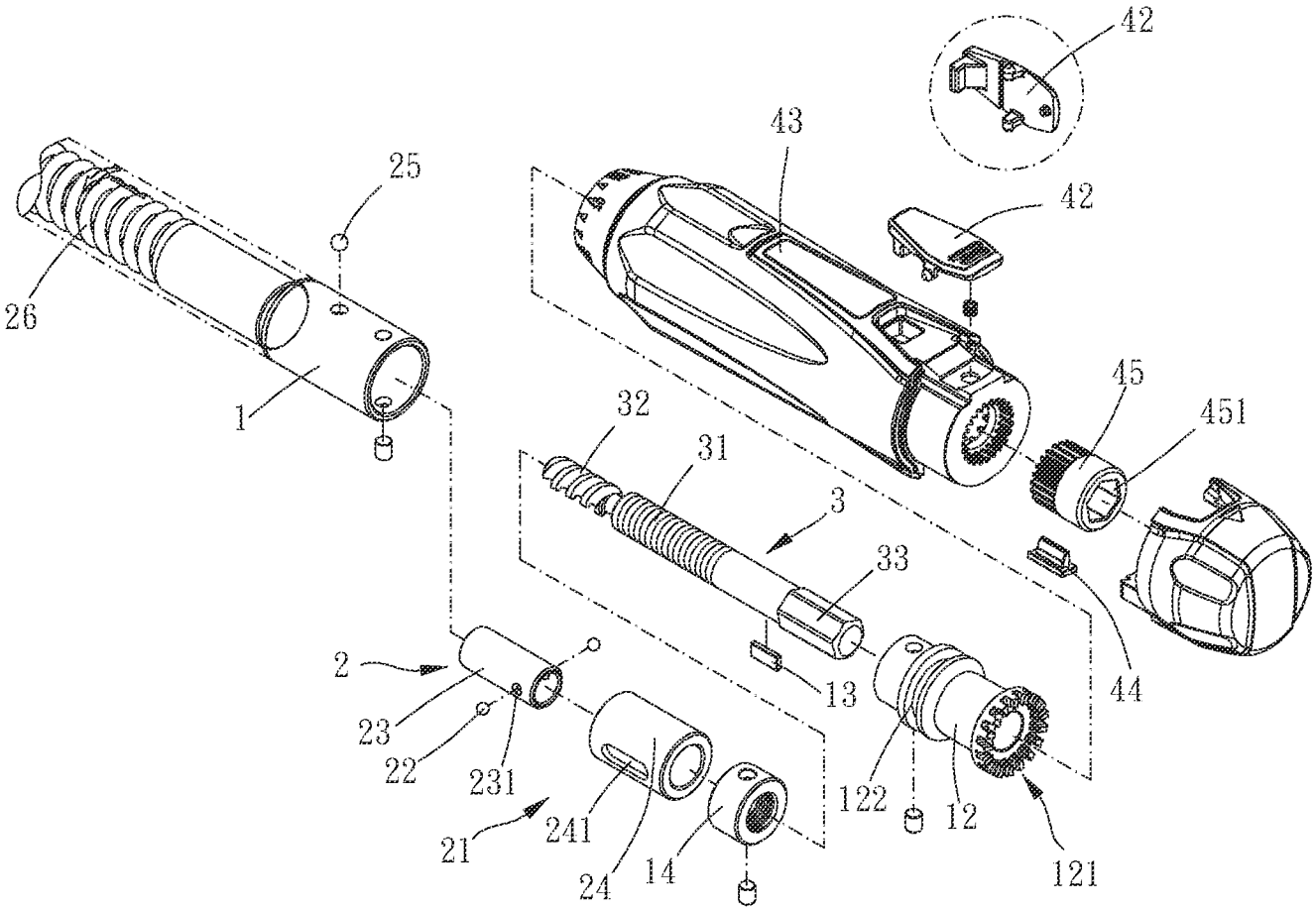
FIG. 2 is a breakdown drawing of a preferable embodiment of the present invention.
Figure 3:
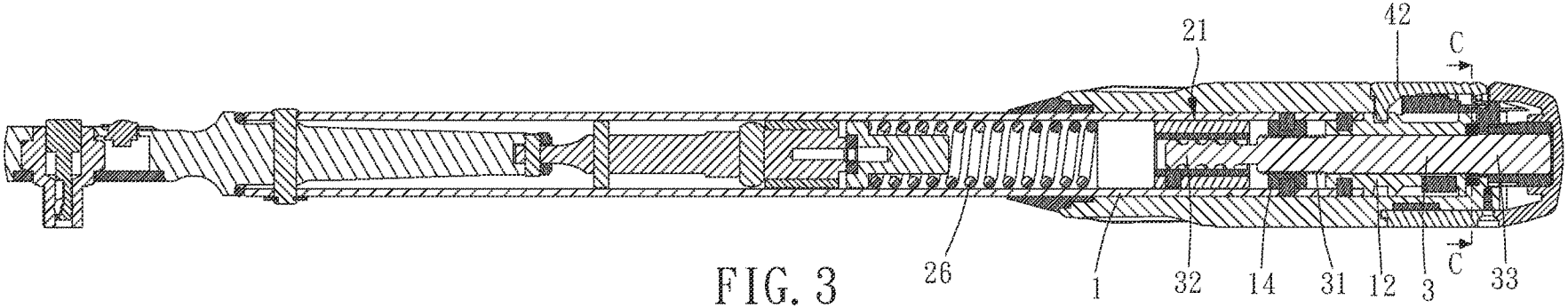
FIG. 3 is a side view of a preferable embodiment of the present invention.
Figure 4:
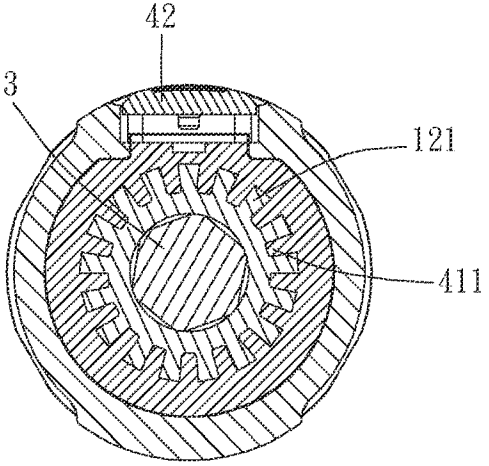
FIG. 4 is a cross-sectional view of FIG. 3, taken along a line C-C.
Figure 5:
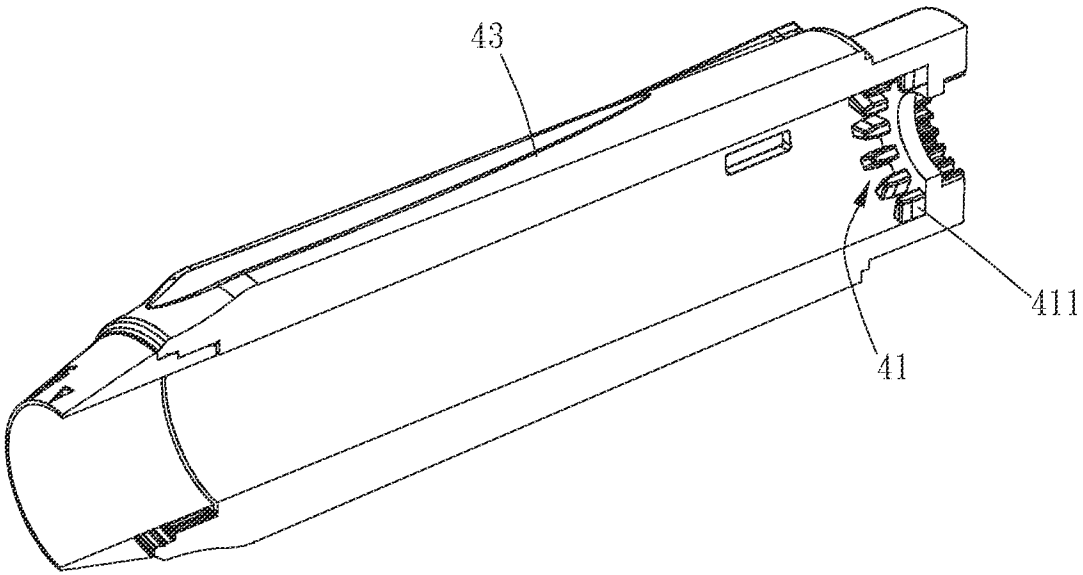
FIG. 5 is a partial cross-sectional view of a grip member of a preferable embodiment of the present invention.
Figure 6:
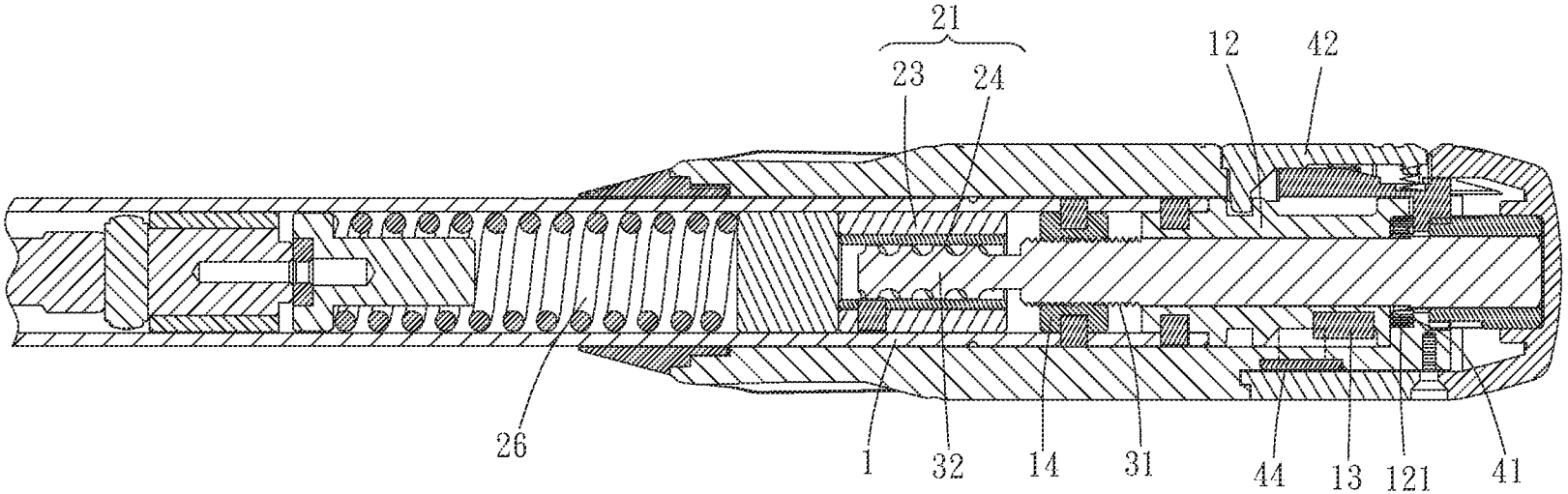
FIGS. 6-8 are cross-sectional views of FIG. 1, taken along a line A-A, showing operation of a preferable embodiment of the present invention.
Figure 7:
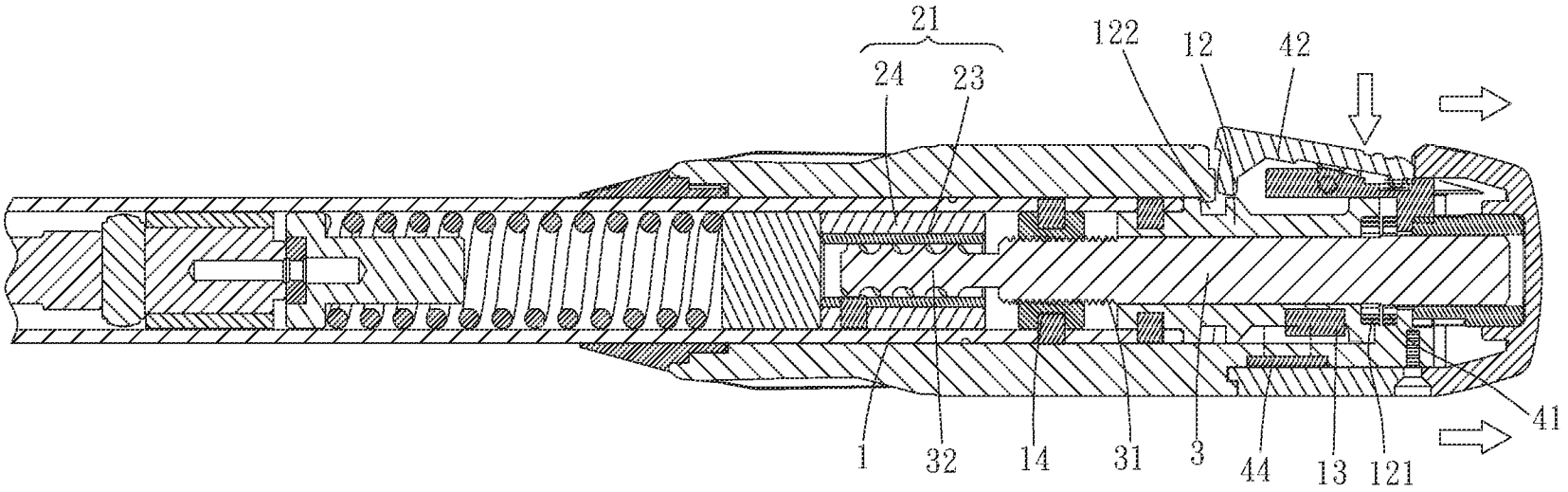
Figure 8:
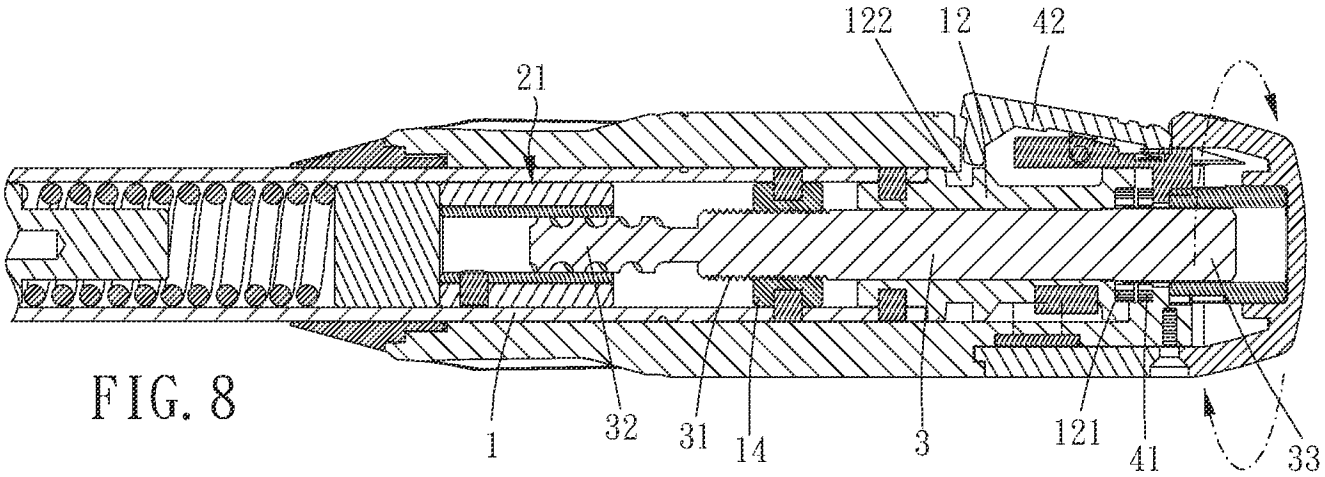
Figure 9:
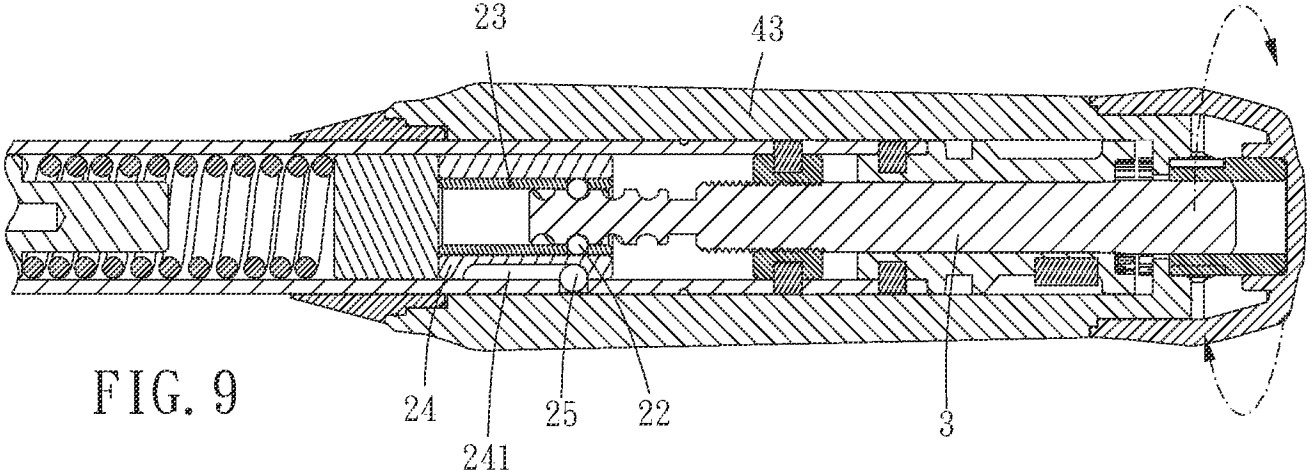
FIG. 9 is a cross-sectional view of FIG. 1, taken along the line B-B, showing operation of a preferable embodiment of the present invention.

Please refer to FIGS. 1 to 9 for a preferable embodiment of the present invention. A torque tool of the present invention includes a main body 1, a torque assembly 2, a shaft 3 and an adjusting assembly 4.

The main body 1 defines an axial direction, an end of the main body 1 on the axial direction includes a working portion 11, and the working portion 11 is freely rotatable when receiving a torque larger than a predetermined torque.

The torque assembly 2 includes an abutting assembly 21, and the abutting assembly 21 is non-rotatably and slidably disposed in the main body 1 in the axial direction for adjusting the predetermined torque. In this embodiment, the torque assembly 2 further includes an elastic member 26, the elastic member 26 is disposed in the main body 1, and the abutting assembly 21 is abutted against the elastic member 26 and configured to urge the elastic member 26 to adjust the predetermined torque.

The shaft 3 includes a first threaded portion 31 and a second threaded portion 32, the first threaded portion 31 and the second threaded portion 32 extend spirally in opposing directions, the first threaded portion 31 is screwed to the main body 1, and the second threaded portion 32 is screwed to the abutting assembly 21. In this embodiment, a positioning member 14 is fixedly disposed in the main body 1, and the first threaded portion 31 is disposed through the positioning member 14 and screwed with the positioning member 14.

The adjusting assembly 4 is rotatably disposed on the main body 1, rotatable about the axial direction, and connected with and non-rotatable relative to the shaft 3.

When the adjusting assembly 4 rotates relative to the main body 1, the adjusting assembly 4 drives the shaft 3 to rotate relative to the main body 1 to move in the axial direction. Since the second threaded portion 32 of the shaft 3 is screwed with the abutting assembly 21, the shaft 3 can drive the abutting assembly 21 to move. Since the abutting assembly 21 is non-rotatably and slidably disposed in the main body 1 in the axial direction, the abutting assembly 21 rotates relative to the shaft 3 during rotation of the shaft 3 relative to main body 1 so that the displacement of the abutting assembly 21 relative to the main body 1 is larger than the displacement of the shaft 3 relative to the main body 1, thus increasing compression of the elastic member 26 by the abutting assembly 21, Therefore, the predetermined torque can be considerably adjusted by less rotation of the adjusting assembly 4.

Specifically, the abutting assembly 21 includes at least one first engagement member 22, and the at least one first engagement member 22 is abutted against a root of the second threaded portion 32 so that the second threaded portion 32 can drive the first engagement member 22 and the abutting assembly 21 during rotation. In other embodiments, the abutting assembly may include a thread mashed with the second threaded portion.

Specifically, the abutting assembly 21 includes an inner sleeve 23 and an outer sleeve 24, the inner sleeve 23 is rotatably disposed around the second threaded portion 32 and includes at least one through hole 231 disposed therethrough, each of the at least one first engagement member 22 is received within one of the at least one through hole 231, the outer sleeve 24 is movable with and disposed around the inner sleeve 23, and the at least one first engagement member 22 is abutted by the outer sleeve 24 to be radially protrusive out beyond an inner wall of the inner sleeve 23. Preferably, an outer wall of the outer sleeve 24 includes a slot 241, the slot 241 extends in the axial direction, the main body 1 further includes a second engagement member 25, and the second engagement member 25 is engaged within the slot 241 so that the outer sleeve 24 can only slide in the axial direction relative to the main body 1 and cannot rotate relative to the main body 1. In this embodiment, the second threaded portion 32 has a thread pitch larger than 1.5 times a thread pitch of the first threaded portion 31, the second threaded portion 32 has an outer diametric dimension smaller an outer diametric dimension of the first threaded portion 31, each of the at least one first engagement member 22 is a ball member.

A positioning member 12 is fixedly disposed on another end of the main body 1 opposite to the working portion 11, the positioning member 12 includes a first toothed portion 121, and the adjusting assembly 4 includes a second toothed portion 41 and is movable along the axial direction to be located in a locking position or a release position. When the adjusting assembly 4 is located in the locking position, the first toothed portion 121 and the second toothed portion 41 are engaged with each other such that the adjusting assembly 4 cannot rotate relative to the main body 1; when the adjusting assembly 4 is located in the release position, the first toothed portion 121 and the second toothed portion 41 are disengaged from each other such that the adjusting assembly 4 can rotate to adjust the predetermined torque.

Preferably, an outer wall of the positioning member 12 includes an annular groove 122, a detent member 42 is disposed on an outer wall of the adjusting assembly 4, the detent member 42 is movable to be located in an engaging position or a disengaging position. When the adjusting assembly 4 is located in the locking position and the detent member 42 is located in the engaging position, the detent member 42 is engaged within the annular groove 122 so that the adjusting assembly 4 cannot move toward the release position; and when the adjusting assembly 4 is located in the locking position and the detent member 42 is located in the engaging position, the detent member 42 is disengaged from the annular groove 122 so that the adjusting assembly 4 can move toward the release position.

One of the first toothed portion 121 and the second toothed portion 41 includes a plurality of teeth 411 tapered toward the other of the first toothed portion 121 and the second toothed portion 41. In this embodiment, the second toothed portion 41 includes the plurality of teeth 411, and the plurality of teeth 411 are tapered toward the first toothed portion 121. When the adjusting assembly 4 moves from the release position toward the locking position, the plurality of teeth 411 can be inserted into the first toothed portion 121 easily without being exactly aligned with the first toothed portion 121, which is easy to operate.

Furthermore, the adjusting assembly includes a grip member 43, and the grip member 43 is rotatably disposed around the main body 1 and movable in the axial direction to be located in the locking position or the release position. The second toothed portion 41 is disposed on an inner wall of the grip member 43, the grip member 43 is non-rotatably connected with the shaft 3.

Specifically, the positioning member 12 further includes a first blocking member 13 projecting radially outward, the adjusting assembly 4 further includes a second blocking member 44 projecting radially inward, and the first blocking member 13 and the second blocking member 44 are blockable with each other circumferentially. The first blocking member 13 and the second blocking member 44 can limit the rotational angle of the adjusting assembly 4, which prevents the first threaded portion 31 and the second threaded portion 32 being disengaged from the main body 1 and the abutting assembly 21. In this embodiment, the second blocking member 44 is disposed on the inner wall of the grip member 43.

In this embodiment, an end of the shaft 3 remote from the working portion 11 includes a non-circular section 33, and the first threaded portion 31 is located between the second threaded portion 32 and the non-circular section 33. The adjusting assembly 4 further includes a driving member 45, the driving member 45 is movable with and disposed in the grip member 43, and the driving member 45 includes a non-circular hole 451 in which the non-circular section 33 is disposed so that the adjusting assembly 4 can drive the shaft 3 to rotate smoothly.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A torque tool, including:

a main body, defining an axial direction, an end of the main body on the axial direction including a working portion, the working portion being freely rotatable when receiving a torque larger than a predetermined torque;

a torque assembly, including an abutting assembly, the abutting assembly being non-rotatably and slidably disposed in the main body in the axial direction for adjusting the predetermined torque;

a shaft, including a first threaded portion and a second threaded portion, the first threaded portion and the second threaded portion extending spirally in opposing directions, the first threaded portion being screwed to the main body, the second threaded portion being screwed to the abutting assembly;

an adjusting assembly, disposed on the main body and rotatable about the axial direction, connected with and non-rotatable relative to the shaft.

2. The torque tool of claim 1, wherein the abutting assembly includes at least one first engagement member, and the at least one first engagement member is abutted against a root of the second threaded portion.

3. The torque tool of claim 2, wherein the abutting assembly further includes an inner sleeve and an outer sleeve, the inner sleeve is rotatably disposed around the second threaded portion and includes at least one through hole disposed therethrough, each of the at least one first engagement member is received within one of the at least one through hole, the outer sleeve is movable with and disposed around the inner sleeve, and the at least one first engagement member is abutted by the outer sleeve to be radially protrusive out beyond an inner wall of the inner sleeve.

4. The torque tool of claim 3, wherein an outer wall of the outer sleeve includes a slot, the slot extends in the axial direction, the main body further includes a second engagement member, and the second engagement member is engaged within the slot.

5. The torque tool of claim 1, wherein a positioning member is fixedly disposed on another end of the main body opposite to the working portion, the positioning member includes a first toothed portion, the adjusting assembly includes a second toothed portion and is movable along the axial direction to be located in a locking position or a release position, when the adjusting assembly is located in the locking position, the first toothed portion and the second toothed portion are engaged with each other, and when the adjusting assembly is located in the release position, the first toothed portion and the second toothed portion are disengaged from each other.

6. The torque tool of claim 5, wherein an outer wall of the positioning member includes an annular groove, a detent member is disposed on an outer wall of the adjusting assembly, the detent member is movable to be located in an engaging position and a disengaging position, when the adjusting assembly is located in the locking position and the detent member is located in the engaging position, the detent member is engaged within the annular groove, when the adjusting assembly is located in the locking position and the detent member is located in the engaging position, the detent member is disengaged from the annular groove.

7. The torque tool of claim 5, wherein one of the first toothed portion and the second toothed portion includes a plurality of teeth tapered toward the other of the first toothed portion and the second toothed portion.

8. The torque tool of claim 7, wherein the adjusting assembly includes a grip member, the grip member is rotatably disposed around the main body and movable in the axial direction to be located in the locking position or the release position, the second toothed portion is disposed on an inner wall of the grip member, and the grip member is non-rotatably connected with the shaft.

9. The torque tool of claim 6, wherein the positioning member further includes a first blocking member projecting radially outward, the adjusting assembly further includes a second blocking member projecting radially inward, and the first blocking member and the second blocking member are blockable with each other circumferentially.

10. The torque tool of claim 3, wherein an outer wall of the outer sleeve includes a slot, the slot extends in the axial direction, the main body further includes a second engagement member, and the second engagement member is engaged within the slot; a positioning member is fixedly disposed on another end of the main body opposite to the working portion, the positioning member includes a first toothed portion, the adjusting assembly includes a second toothed portion and is movable along the axial direction to be located in a locking position or a release position, when the adjusting assembly is located in the locking position, the first toothed portion and the second toothed portion are engaged with each other, and when the adjusting assembly is located in the release position, the first toothed portion and the second toothed portion are disengaged from each other; an outer wall of the positioning member includes an annular groove, a detent member is disposed on an outer wall of the adjusting assembly, the detent member is movable to be located in an engaging position or a disengaging position, when the adjusting assembly is located in the locking position and the detent member is located in the engaging position, the detent member is engaged within the annular groove, when the adjusting assembly is located in the locking position and the detent member is located in the engaging position, the detent member is disengaged from the annular groove; one of the first toothed portion and the second toothed portion includes a plurality of teeth tapered toward the other of the first toothed portion and the second toothed portion; the adjusting assembly includes a grip member, the grip member is rotatably disposed around the main body and movable in the axial direction to be located in the locking position or the release position, the second toothed portion is disposed on an inner wall of the grip member, and the grip member is non-rotatably connected with the shaft; the positioning member further includes a first blocking member projecting radially outward, the adjusting assembly further includes a second blocking member projecting radially inward, and the first blocking member and the second blocking member are blockable with each other circumferentially; the torque assembly further includes an elastic member, the elastic member is disposed in the main body, the abutting assembly is abutted against the elastic member and configured to urge the elastic member to adjust the predetermined torque; an end of the shaft remote from the working portion includes a non-circular section, the first threaded portion is located between the second threaded portion and the non-circular section, the adjusting assembly further includes a driving member, the driving member is movable with and disposed in the grip member, and the driving member includes a non-circular hole in which the non-circular section is disposed; the second threaded portion has a thread pitch larger than 1.5 times a thread pitch of the first threaded portion; the second threaded portion has an outer diametric dimension smaller than an outer diametric dimension of the first threaded portion; the second blocking member is disposed on the inner wall of the grip member; an another positioning member is fixedly connected in the main body, and the first threaded portion is disposed through the another positioning member and screwed with the another positioning member.

* * * * *